United States Patent [19]

Kieffer

[11] Patent Number: 4,559,752

[45] Date of Patent: Dec. 24, 1985

[54] BUILDING CONSTRUCTION PANEL WITH INTERNAL METALLIC REINFORCEMENT

[76] Inventor: Joseph A. Kieffer, Abbaye de Roseland, Baccara 3, 06200 -Nice, France

[21] Appl. No.: 530,593

[22] PCT Filed: Dec. 17, 1982

[86] PCT No.: PCT/FR82/00214

§ 371 Date: Aug. 8, 1983

§ 102(e) Date: Aug. 8, 1983

[87] PCT Pub. No.: WO83/02129

PCT Pub. Date: Jun. 23, 1983

[30] Foreign Application Priority Data

Dec. 17, 1981 [FR] France ..... 81 23618
Aug. 18, 1982 [FR] France ..... 82 14293

[51] Int. Cl.[4] ..... E04C 2/42; E04C 5/04; E04C 1/00; E04B 5/04

[52] U.S. Cl. ..... 52/670; 52/309.7; 52/612

[58] Field of Search ..... 52/309.7, 309.11, 309.12, 52/612, 670

[56] References Cited

U.S. PATENT DOCUMENTS

| | | | |
|---|---|---|---|
| 3,111,204 | 11/1963 | Phere | 189/34 |
| 3,825,465 | 7/1974 | Stock | 428/131 X |
| 4,125,981 | 11/1978 | MacLead et al. | 52/309.12 |
| 4,283,896 | 8/1981 | Fricter et al. | 52/309.12 X |
| 4,336,676 | 6/1982 | Artzer | 52/309.11 X |

FOREIGN PATENT DOCUMENTS

| | | |
|---|---|---|
| 2422091 | 11/1974 | Fed. Rep. of Germany . |
| 493868 | 8/1919 | France . |
| 2265538 | 10/1975 | France . |
| 114059 | 3/1918 | United Kingdom . |

*Primary Examiner*—Michael R. Lusignan
*Attorney, Agent, or Firm*—Mason, Fenwick & Lawrence

[57] ABSTRACT

This invention relates to a three-dimensional monolithic structure of expanded metal formed from an expandable metal place sheet usable in a building construction panel, said structure exhibiting mutually parallel ribs at opposite first and second faces of the structure and inclined cross-struts formed by interrupted cutting lines in the sheet, the cross-struts inwardly joining the ribs at shaped joint nodes of shapes formed by cutting lines.

6 Claims, 14 Drawing Figures

BUILDING CONSTRUCTION PANEL WITH INTERNAL METALLIC REINFORCEMENT

The present invention relates to a panel, and more specifically to the internal metallic reinforcement which it comprises, intended for building construction. These panels form the framework and the facing of the structure and can then be used to produce the internal and external walls, floors, ceilings and roofs.

The metallic reinforcement of the known panels generally consists of two mutually parallel metallic lattices maintained at constant interval by distinct metallic elements serving for spacing and for attachment by welding, clamping, hooking, trying et cetera; the lattices in question consist of sufficiently large metallic wires welded together in the form of meshes, or else by wire-based metallic netting.

A cheap and relatively light filler material can be enclosed between the two lattices, leaving the lattices superficially free so that covering material can be attached to said lattices by engagement and penetration between the meshes, these materials possibly consisting of mortar, concrete, plaster . . . and being introduced. by pouring, foaming, et cetera. The metallic spacing elements are also welded to the lattices.

The disadvantage of the reinforcement of these known panels lies in the fact that it is practically impossible to produce an automatic machine which can perform the attachment, preferably by welding, of the metallic lattices to the spacing elements. This practical impossibility results from the fact that it is necessary to operate on round metallic wires and to make a very large number of welds in all directions of a three-dimensional space.

The invention seeks to obviate this major disadvantage, which prevents any economical application of said panels.

In order to achieve this aim, and according to the invention, the reinforcement of the panel is exclusively a framework of "expanded metal" in a three-dimensional structure exhibiting mutually parallel ribs at the surface and inclined cross-struts, joining these ribs, inside. Thus the production of the reinforcement involves only the cutting and expansion of a metallic sheet; it is therefore free from the operations of positioning and welding of the components which hitherto made the application of such panels insufficiently profitable to occupy the desired position in economic construction.

More specifically, and by way of illustration without implying a limitation, the invention consists:

in that the ribs of the framework before "expansion" are mutually parallel and mutually spaced, these ribs being intended to form the surface bars of the reinforcement located on one side when they are of even rank and on the other side when they are of odd rank, in that the cross-struts joining the ribs extend between them and are separated from the latter by interrupted cutting lines defining the edges of said ribs, whereas the two ends of each cross-strut remain fixed, the one to a rib of even rank and the other to a rib of odd rank, forming joint nodes, and in that the distribution of the joint nodes when the metal is plane and unexpanded is different from the distribution of these nodes in projection onto this plane when the metal is expanded into a three-dimensional structure, inasmuch as during the expansion, the ribs of even rank must be moved parallel to themselves in an oblique direction so as not only to move the ribs of odd rank away from the plane defined by the ribs of even rank, but likewise to incline the cross-struts concomitantly.

According to a particularly advantageous embodiment, each node of a rib of even rank connects the adjacent ends of two cross-struts, respectively extending on the two sides of the relevant rib and in the same direction, the direction being reversed for the cross-struts of the two consecutive ribs of even rank; each node of a rib of odd rank connects the adjacent ends of two cross-struts and extending respectively on the two sides of the relevant rib and in opposite directions, the directions being reversed for the homologous cross-struts of two consecutive ribs of odd rank.

According to a preferred embodiment, the joint nodes are arranged, on the plane unexpanded metal, along lines perpendicular to the ribs, and during expansion, if the nodes of the ribs of odd rank are anchored longitudinally, on the contrary the nodes of each rib of even rank are moved longitudinally, sometimes in one direction for a given rib of even rank, and sometimes in the opposite direction for the two ribs of even rank consecutive thereto, so that the cross-struts are inclined oppositely for two consecutive ribs of even rank.

However, each connecting node consists of that part of the corresponding rib on which the two cross-struts which are connected thereto terminate, this part being included within the four contiguous interruption points of the two interrupted cutting lines of this rib, two diagonally opposite points being joined by skew cuts to the cut edges of the cross-struts located on each side of the relevant rib.

The panels being thus constituted, at the time of their placing in mutual extension and in contact by their extreme edges defined by the even terminal ribs of one face and odd terminal ribs of opposite face, the ribs of each panel cooperate with regularly spaced transverse bars, the ends of which are fixed, particularly by forced hooking, to the ribs of the two contiguous panels.

Various other characteristics and advantages of the invention will further emerge from the detailed description given below.

Embodiments of the subject of the invention are illustrated, by way of examples and without implying a limitation, in the accompanying drawing.

Figure 1:
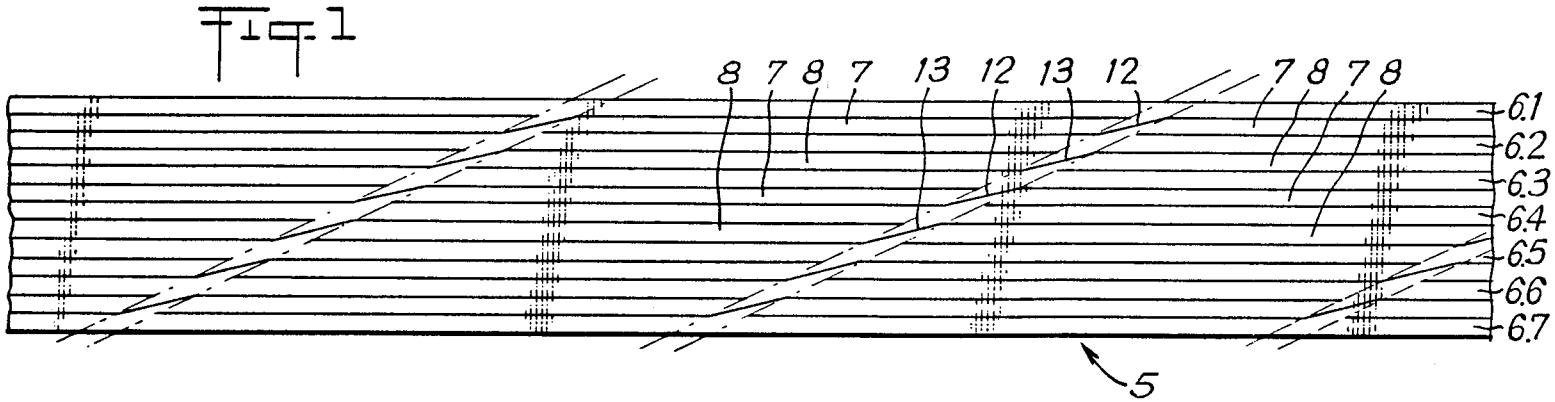
FIG. 1 is a partial plan view showing a first embodiment of the unexpanded but precut metal according to the invention.
Figure 2:
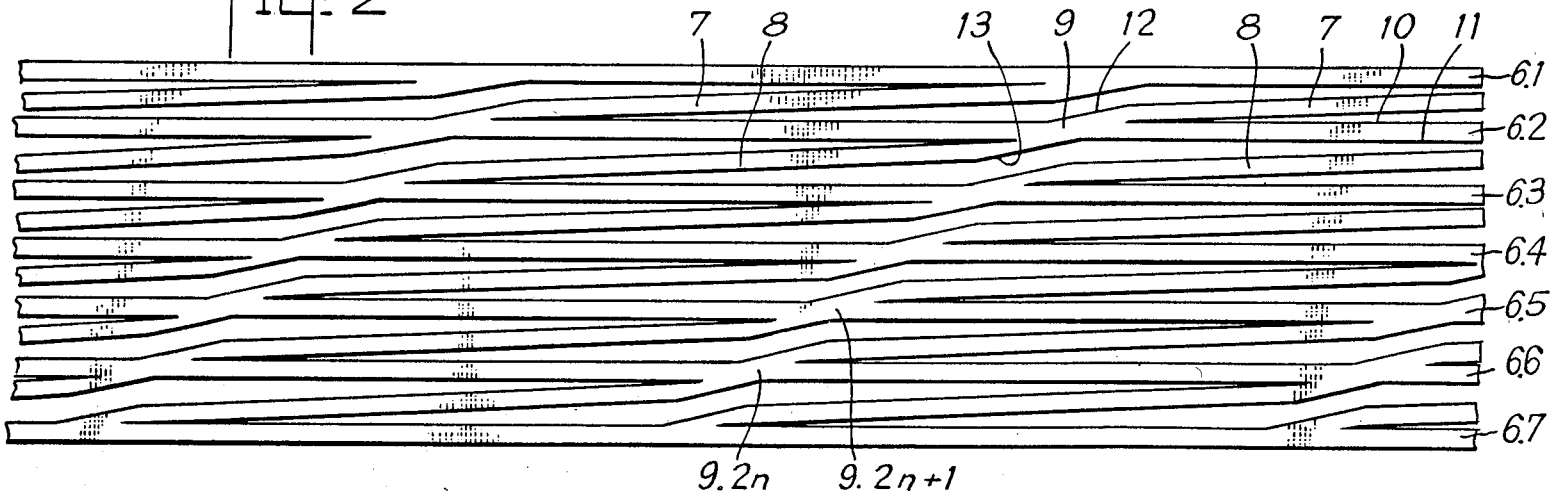
FIG. 2 is a plan view similar to FIG. 1 illustrating the start of the expansion and showing the various components of the framework or reinforcement of the panels according to the invention.
Figure 3:
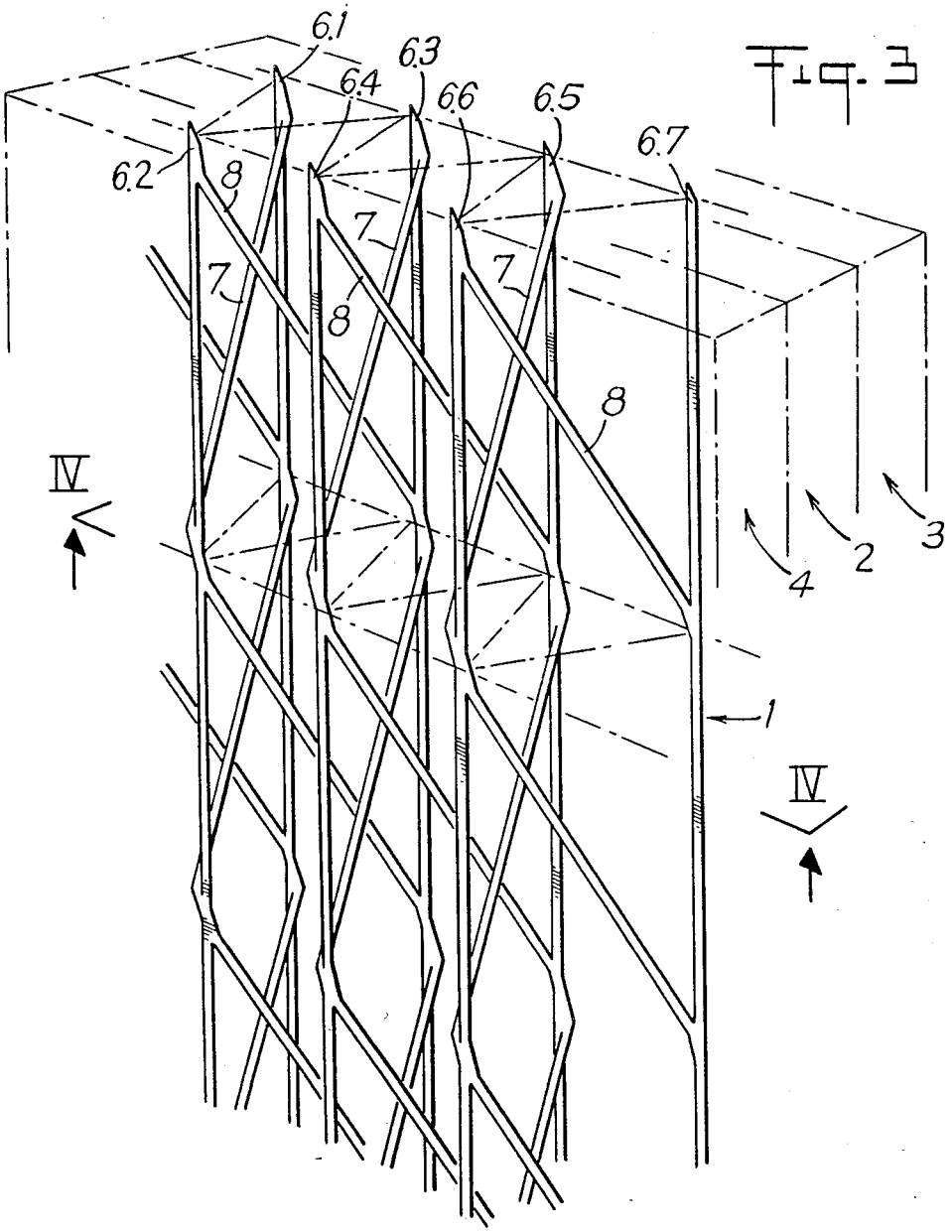
FIG. 3 is a partial perspective view illustrating this framework or reinforcement expanded from the precut metal according to FIGS. 1 and 2.
Figure 4:
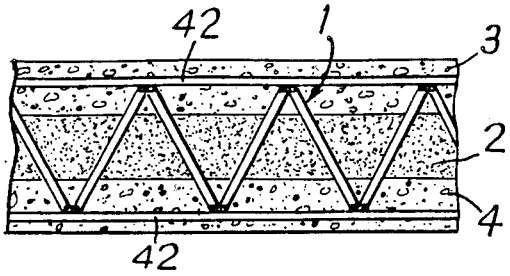
FIG. 4 is a partial section made along the line IV—IV of FIG. 3.
Figure 5:
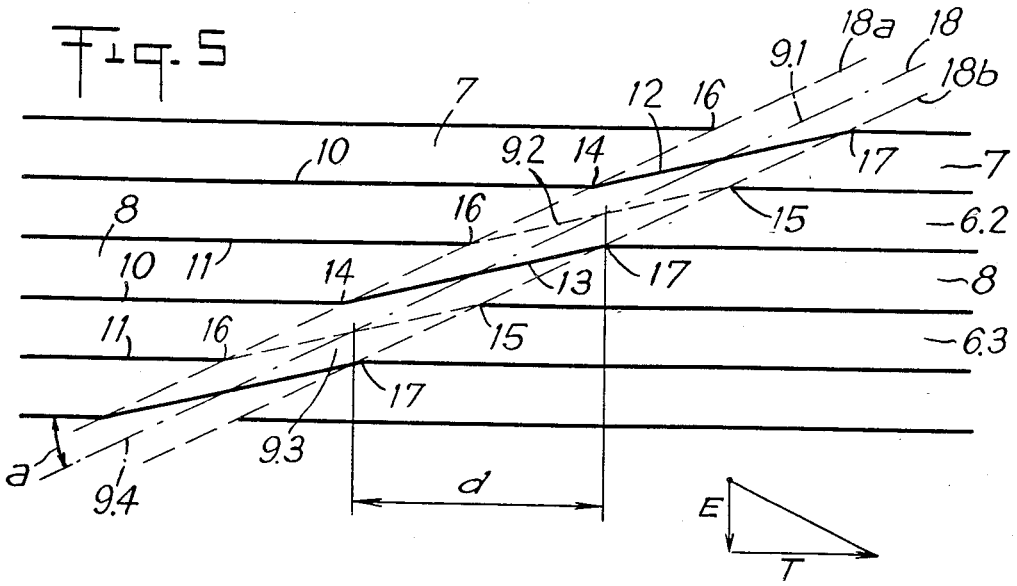
FIG. 5 is a partial elementary plan view similar to FIG. 1, but showing on a larger scale two successive nodes of the metal before expansion.
Figure 6:
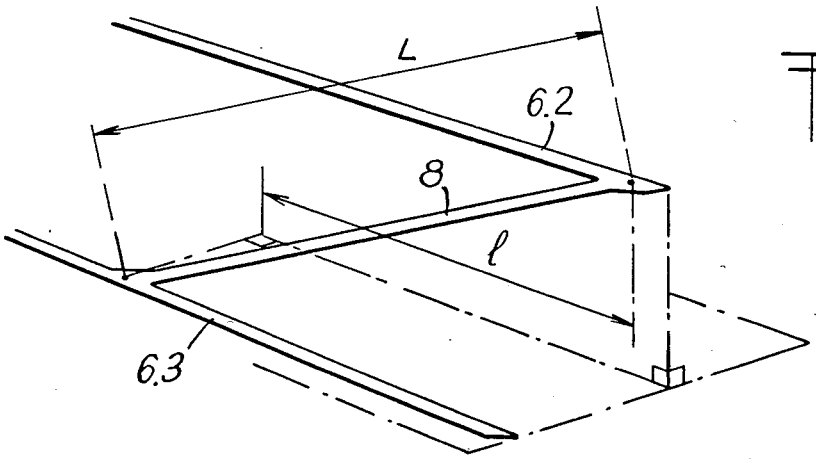
Figure 7:
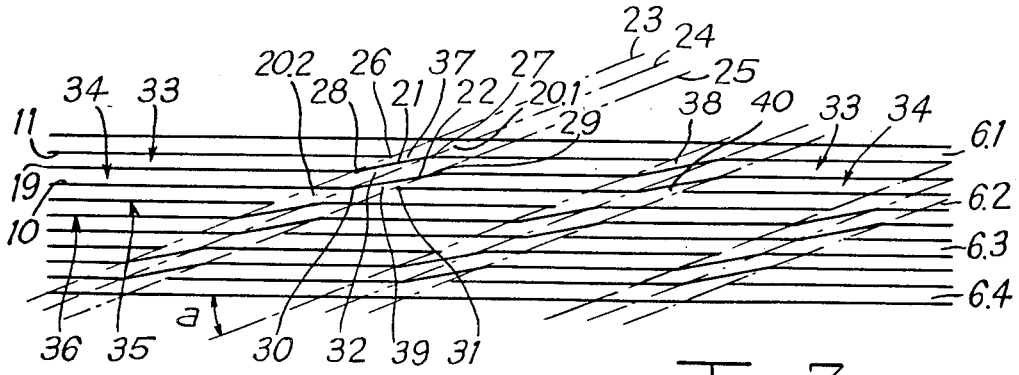
Figure 8:
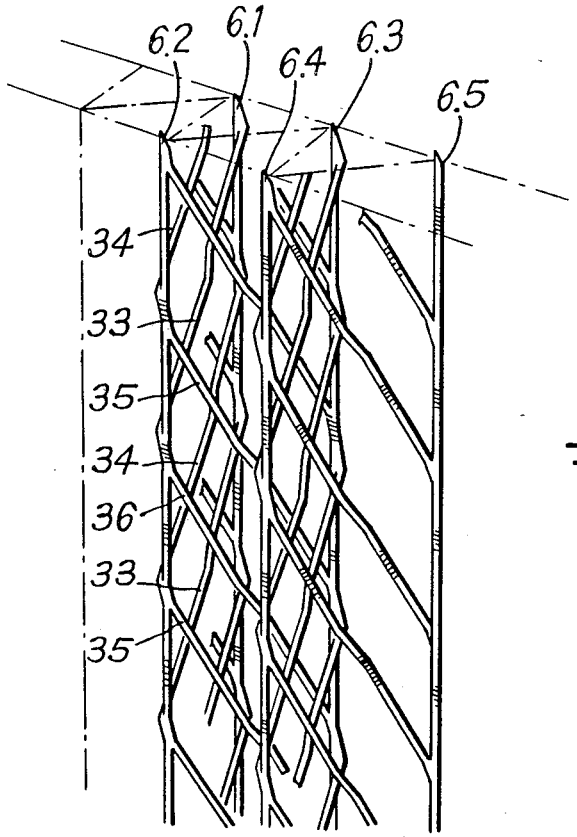
Figure 9:
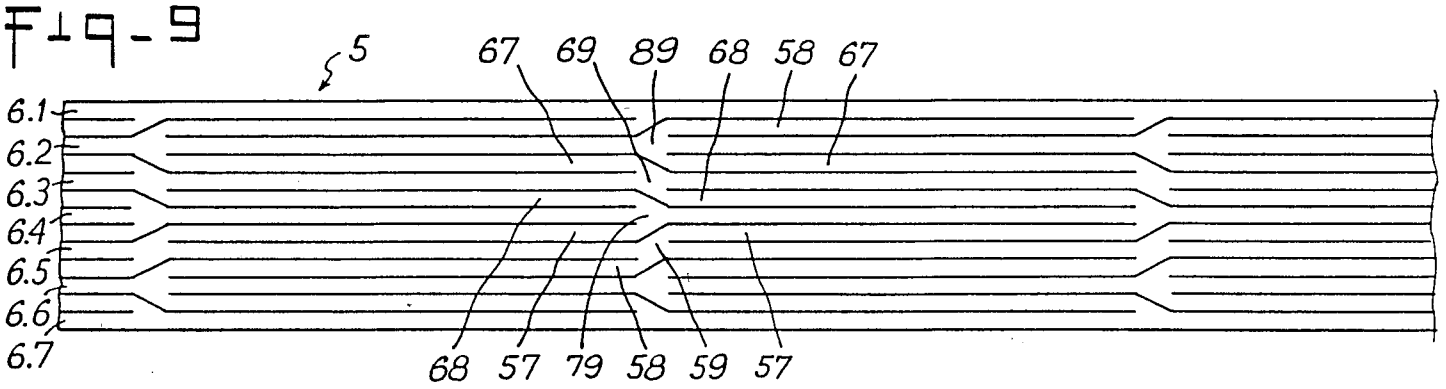
Figure 10:
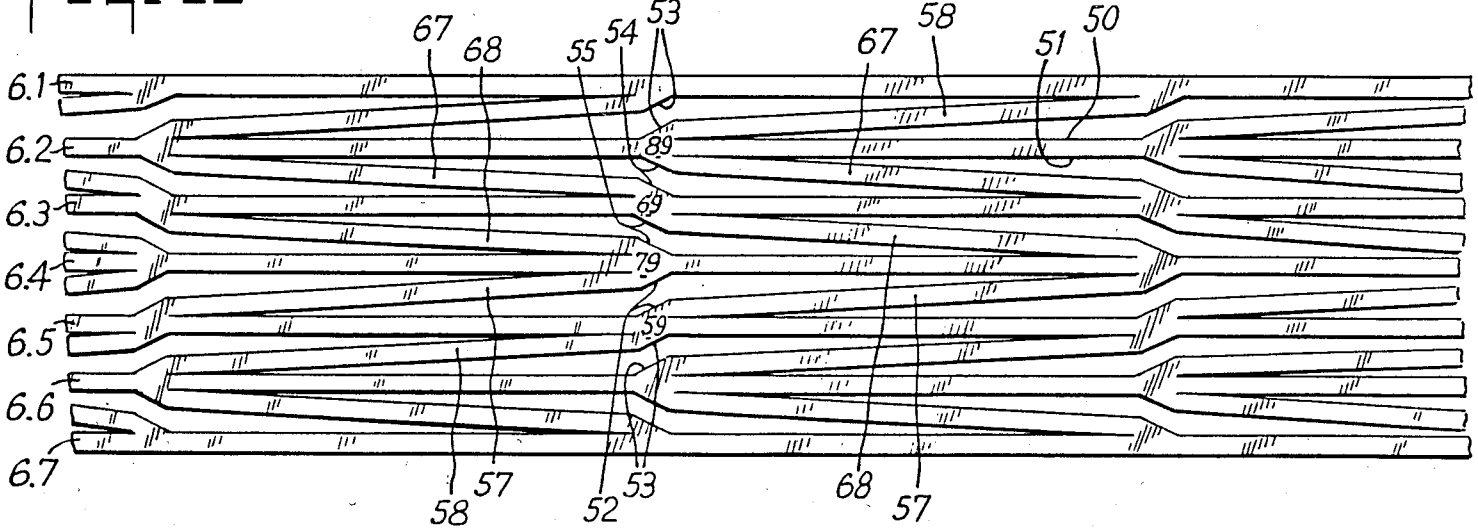
Figure 11:
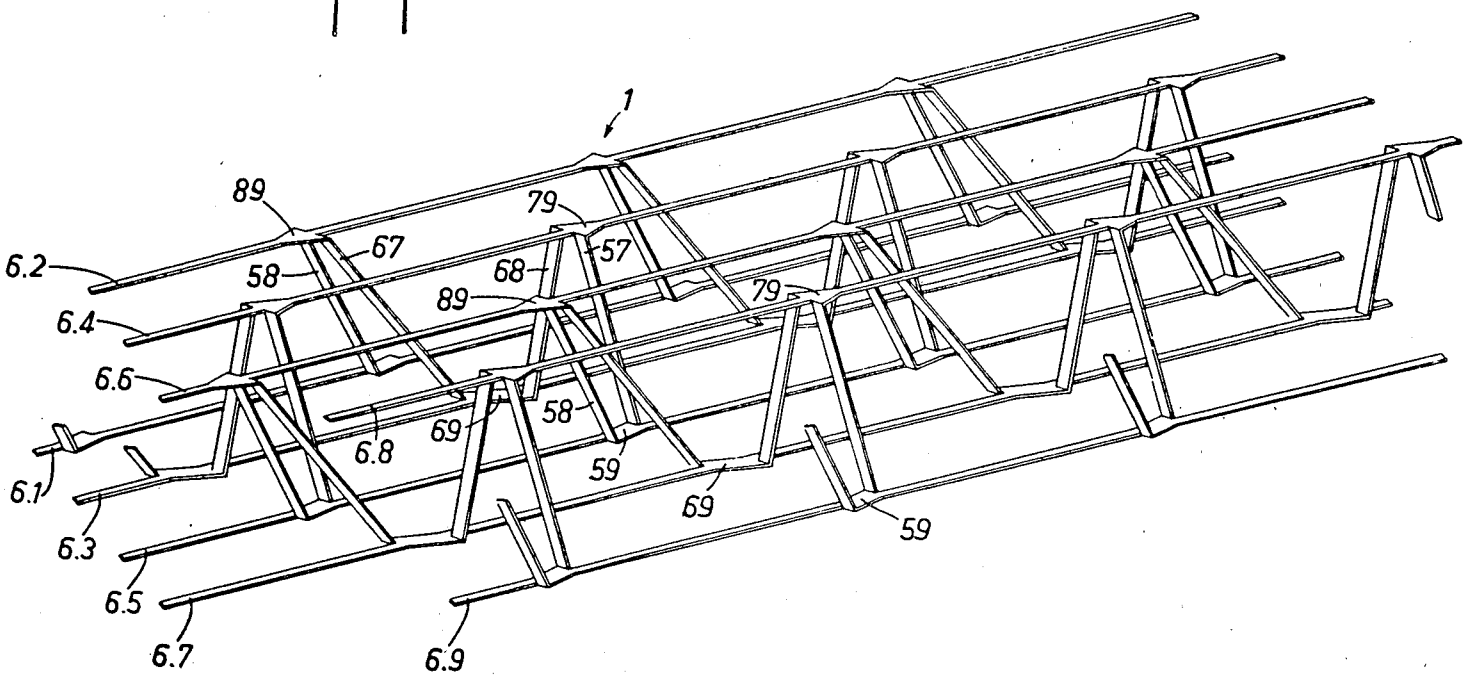
Figure 12:
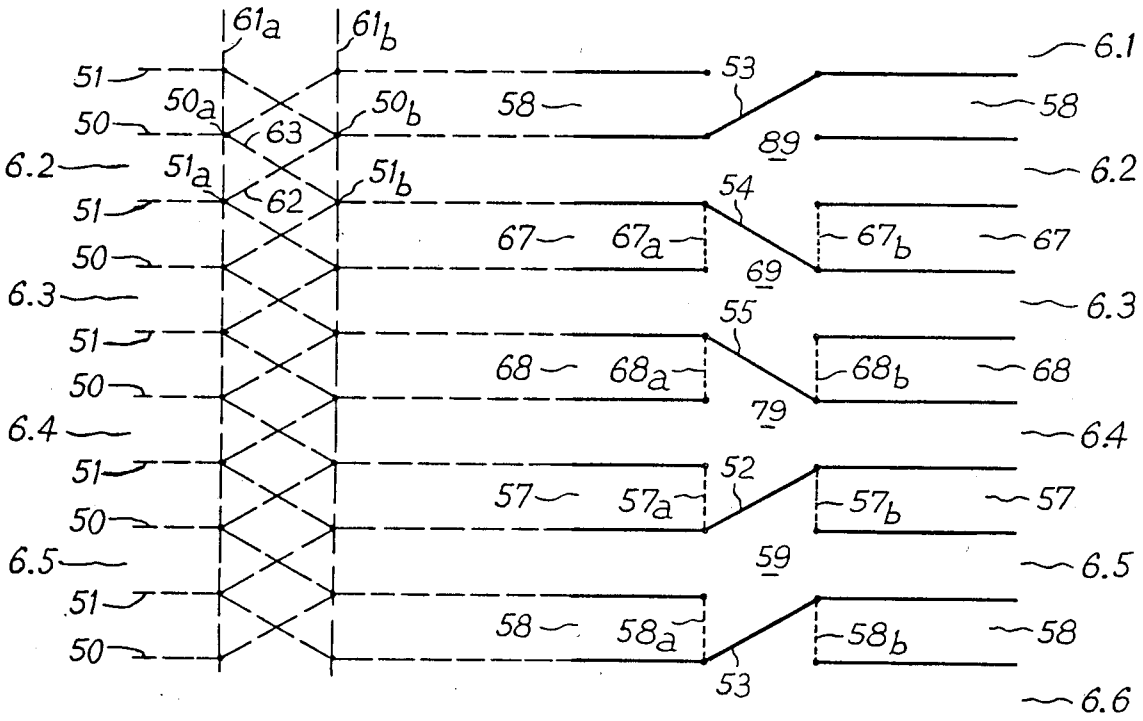
Figure 13:
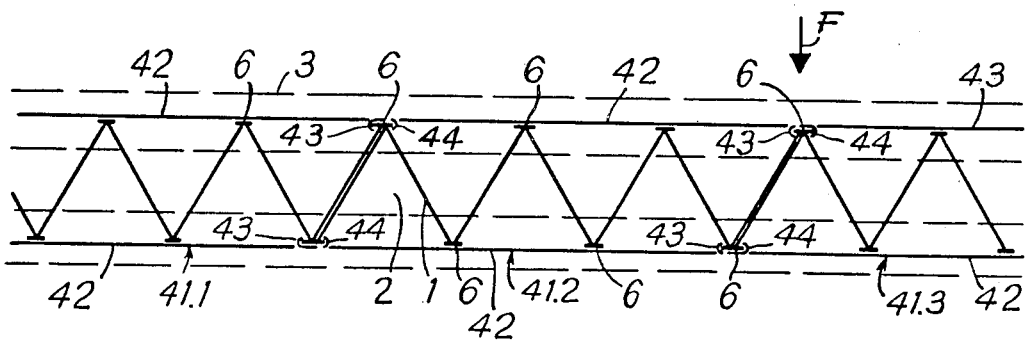
Figure 14:
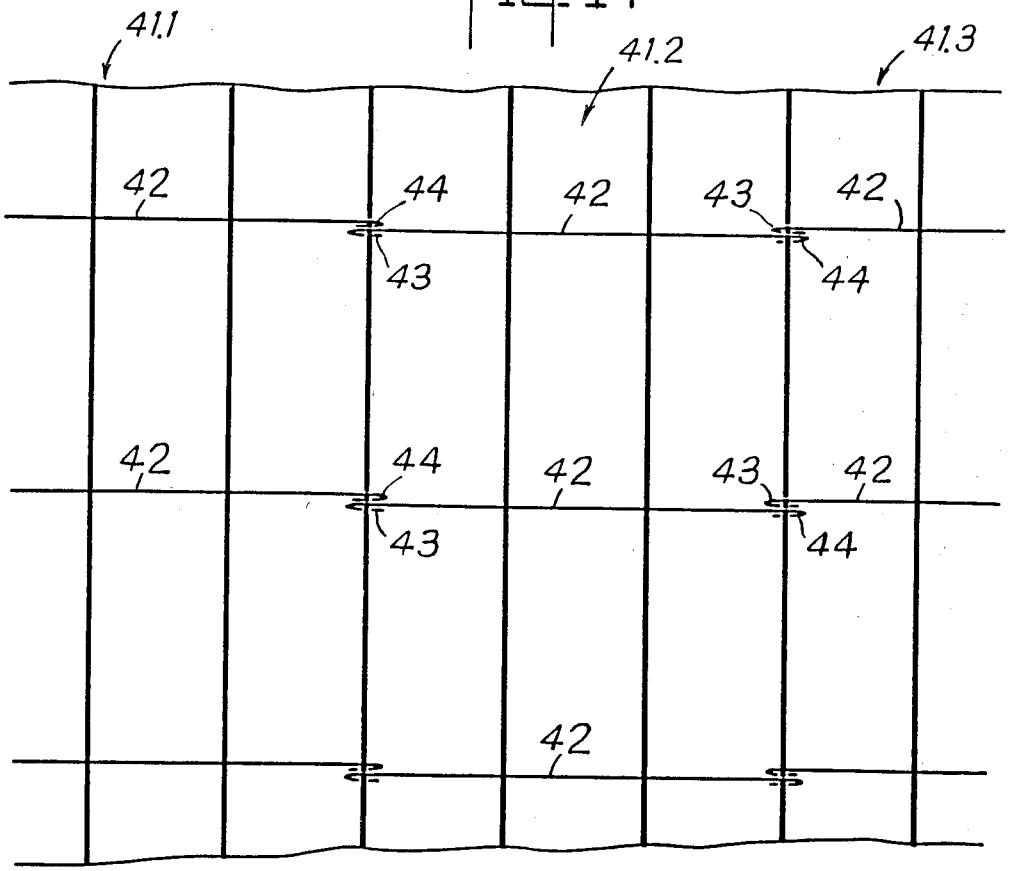

FIG. 6 is a partial elementary perspective view similar to FIG. 3, but showing from a different aspect the two extreme nodes of one and the same cross-strut joined to two ribs, FIGS. 7 and 8 are views similar to FIGS. 1 and 3 respectively and illustrate a second embodiment of the framework or reinforcement of the panels according to the invention, the metal being precut and unexpanded in FIG. 7, and expanded into a three-dimensional structure in FIG. 8, FIGS. 9 to 12 are views similar to FIGS. 1, 2, 3 and 5 respectively, relating to a third embodiment, the metal being precut and unexpanded in FIG. 9, partly expanded in FIG. 10, expanded into a three-dimensional structure in FIG. 11, and shown diagrammatically flat for five successive nodes in FIG. 12, FIG. 13 is a view similar to FIG. 4 showing a mutual assembly of a plurality of panels to form a wall, FIG. 14 is an elevation made in the direction of the arrow F of FIG. 13.

As the example in FIG. 4 clearly shows, the panel according to the invention comprises a reinforcement 1 of expanded metal, a layer 2 of filler material, such as plastic foam, and surface coverings 3, 4 of mortar, plaster, etc.... The layer 2 is enclosed within the reinforcement 1 and coats the components of the latter, thus also contributing to the overall rigidity and strength of the panel. At least some of these components project from the insulating layer and consequently permit the engagement by projection of the coverings when the panels are mutually assembled in the manner described below with reference to FIGS. 13 and 14.

The sheet of metal 5 (FIGS. 1, 2 and 5 or 7) intended for the production of the reinforcement 1 is preferably in steel, and it is precut in order to generate, when it is expanded, the three-dimensional reinforcement structure 1 illustrated in FIG. 3 or FIG. 8 or 11.

According to the first embodiment illustrated in FIGS. 1 to 6, the sheet 3 comprises mutually parallel and mutually spaced ribs; these ribs are designated by the general reference 6 and are distinguished from one another by an index; it is important to note immediately that the ribs of odd rank 6.1, 6.3, 6.5, 6.7..., 6.2n+1 are intended to define one of the faces of the reinforcement, whereas the ribs of even rank 6.2, 6.4, 6.6 ... 6.2n are intended to define the opposite face of said reinforcement.

The ribs 6 are mutually separated, whatever their rank, by solid parts of the sheet 5 intended to form cross-struts; between the consecutive ribs 6.1 and 6.2, 6.3 and 6.4, 6.5 and 6.6 ..., the cross-struts 7 extend each other, and in the same way, the cross-struts 8 likewise extend each other between the ribs 6.2 and 6.3, 6.4 and 6.5, 6.6 and 6.7.... The cross-struts 7 and 8 associated with one and the same rib 6 are paired two by two in the sense that the adjacent ends of one end the same set of cross-struts 7 and 8 are fixed to one another and to the corresponding rib to form a joint node 9; it will immediately be seen that in the set in question, the cross-strut 7 departs from the node 9 to the right (FIG. 2), whereas the cross-strut 8 departs from the same node to the left.

By virtue of this feature, when the sheet 5 is expanded the cross-struts are inclined as is clear in FIG. 3, but not in a random manner, since the cross-struts 7 and 8 diverge from one another, the cross-struts 7 remaining mutually parallel, in the same way, moreover, as the cross-struts 8, which also remain mutually parallel.

In order to obtain this particular arrangement of the ribs, the cross-struts and the nodes, each rib is delimited by two interrupted cutting lines 10, 11, the interruptions of which permit solid parts to be left which in fact form the above-mentioned joint nodes 9. It must also be borne in mind that said cutting lines 10 and 11 permit the ribs 6 to be separated from the cross-struts 7 and 8; so that the separation of the latter is complete except for the nodes 9, skew cuts 12 and 13, without destroying the relevant nodes, join the cutting line 10 of one rib to the cutting line 11 of the adjacent rib; moreover, it is likewise noteworthy that each of the skew cuts 12 and 13 separates a node 9.2n of even rank from a node 9.2n+1 of odd rank; at the same time, the skew cuts 12 mutually separate the cross-struts 7 so that, during expansion, these cross-struts are inclined in one direction, whereas the skew cuts 13 separate the cross-struts 8 so that during the same expansion, these cross-struts are inclined in the opposite direction to that of the cross-struts 7.

FIG. 5 illustrates the cutting in detail, and therefore permits the joints between the constituent elements of the framework to be specified. Thus the interrupted cutting line 10 of the rib 6.2 terminates, as regards the node 9.2, in two interruption points 14, 15, and in the same way, the interrupted cutting line 11 of this rib 6.2 terminates, for the node 9.2, in two interruption points 16, 17. The same points 14 to 17 recur for the node 9.3 homologous to the previous one 9.2 and aligned with the latter on an oblique line 18 having a slope a, defined below, relative to the ribs 6. The points 14 and 17 of each node are diagonally opposite. This being stated, the point 14 of the node 9.2 is joined to the point 17 of the node 9.1 which precedes it, by a skew cut 12 mutually separating two cross-struts 7, and similarly, the point 17 of this node 9.2 is joined to the point 14 of the node 9.3 which follows it, by a skew cut 13 mutually separating two cross-struts 8.

The other points 15 and 16 of each node are like-wise diagonally opposite; they mark the end of the separation of the cross-struts relative to the ribs. The cutting of the sheet 5 being thus performed, it is clear that the ribs 6 are mutually separated for the greater part of their length, but that they are nevertheless joined to one another by the cross-struts 7 and 8 terminating at joint nodes 9, the cross-struts 7 being directed in the opposite direction to that of the cross-struts 8.

To effect the expansion of the metal for the purpose of obtaining the framework illustrated in FIG. 3, it is first of all necessary to maintain the ribs of even rank 6.2n against a reference plane, whilst nevertheless not opposing their coplanar movement, and then to leave the ribs of odd rank 6.2n+1 free to move in space. In fact, this involves pulling the ribs of even rank, in the above-mentioned reference plane, in an oblique direction such that the oblique lines 18 of the homologous nodes 9 become perpendicular to the ribs and this movement of said ribs must be effected so that they remain parallel to one another at all times. This oblique movement results from the concomitant combination, on the one hand, of the separation of the ribs of even rank two by two in the direction E perpendicular to them, and on the other hand, from the translation of the two relevant ribs relative to each other in the direction T, which is that of the ribs themselves. In the course of this oblique movement, the ribs of odd rank 6.2n+1 move away from the above-mentioned reference plane to define another plane parallel thereto, the two relevant planes being in fact those of the faces of the reinforcement 1; at the same time as these ribs of odd rank separate (both in the reference plane and in projection onto this reference plane of the ribs of even rank) the cross-struts are inclined. Considering FIG. 3, it will be noted that the ribs of even rank 6.2n are located in the plane nearest the observer, whereas the ribs of odd rank 6.2n+1 are located in the farthest plane; in the same illustration, it will be seen that the cross-struts 7 are inclined not only laterally and in depth (that is to say, from right to left and from front to rear) from the ribs of even rank towards the ribs of odd rank, but likewise longitudinally and in depth (that is to say from the bottom of the page to the top and from front to rear) from the ribs of even rank towards the ribs of odd rank; on the other hand, the cross-struts 8 are inclined oppositely to the cross-struts 7, inasmuch as they are directed in depth laterally to the right and longitudinally downwards.

This analysis of the expansion of the metal shows that the slope a of the line 18 of the homologous nodes 9 is perfectly defined; indeed the distance d between two consecutive homologous nodes, 9.2 and 9.3 for example (FIG. 5), is equal to the difference between the length L of the cross-strut 8 taken between these two extreme nodes 9 and the length l of the projection of this cross-strut onto one of the corresponding ribs, the rib 6.2 for example (FIG. 6). In other words, the slope a of the oblique lines 18 of the homologous nodes 9 relative to the ribs 6 is determined in relation to the loss of length in projection onto a rib of the cross-struts when they are inclined in space; with such a slope, the homologous nodes are aligned perpendicularly to the ribs when the metal is expanded, as is clear from FIG. 3. Obviously, the homologous nodes 9 of the sheet 5 may be aligned in lines perpendicular to the ribs 6; in this case, it is quite obvious that, when the metal is expanded into a three-dimensional structure, said homologous nodes are located on oblique lines, the slope of which depends as previously upon the loss of length in projection onto a rib of the cross-struts when they are inclined.

FIGS. 7 and 8 show a second embodiment of the three-dimensional structure which may be produced to form the armature 1 of the panel. In this second embodiment, it is desired to multiply the number of the cross-struts in order to increase their density between the ribs and/or to increase the thickness of the reinforcement obtained by expansion.

The ribs of even rank 6.2, 6.4 . . . , 6.2n+1 and the ribs of odd rank 6.1, 6.3 . . . , 6.2n+1 recur in this second embodiment. As previously, these ribs are mutually parallel and separated by solid parts. But whereas, in the first embodiment, each solid part is separated by the skew cuts into cross-struts mutually aligned and each abutting the two contiguous ribs, in this second embodiment, each solid part is divided, in the manner described below, into cross struts which not only extend each other for a part of their length, but likewise run side by side for another part of their length between said contiguous ribs.

Thus, each solid part separating two contiguous ribs is delimited by the above-mentioned interrupted cutting lines 10 and 11; moreover, another interrupted cutting line 19 extends between the first two.

Between two consecutive homologous joint nodes 20.1 and 20.2, the cutting lines 10, 11 and 19 of the solid part which extend between these nodes are joined to one another by two mutually parallel skew cuts 21 and 22; corresponding to these nodes 20.1 and 20.2, there are three imaginary oblique lines 23 to 25 which permit the interruption points of the interrupted cutting lines to be defined, as was the case of the lines 18*a* and 18*b* of the first embodiment (FIG. 5). Under these conditions, the line 11 exhibits interruption points 26 and 27 on the oblique lines 23 and 24; the line 19 exhibits interruption points 28 and 29 on the oblique lines 23 and 25; the line 10 exhibits interruption points 30 and 31 on the oblique lines 24 and 25. The skew cut 21 joins the points 27 and 28; the skew cut 22 joins the points 29 and 30; these two skew cuts are mutually parallel and delimit between them a kind of oblique bridge 32 giving a sinuous profile to the cross-struts 33 and 34 which must be cut and manually separated in the solid part extending between the ribs 6.1 and 6.2. It results from the above, referring to FIG. 7, that the right hand ends of the cross-struts 33 and 34 extend each other and are separated from the rib 6.1 by the cutting line 11; moreover, these right hand ends of the cross struts are juxtaposed with the left hand ends of the same series of cross-struts, the left hand and right-hand ends being mutually separated by the cutting line 19; lastly, the left-hand ends of said cross-struts of the same series are located along the rib 6.2 and separated from the latter by the cutting line 10. Furthermore, the joint nodes 37 (of the cross-strut 33 with the rib 6.1) and 37 (of the cross-strut 34 with the same rib 6.1) are delimited by the interruption points 26 of the line 11 as well as by the skew cuts 21; analogously, the joint nodes 39 (of the cross-strut 33 with the rib 6.2) and 40 (of the cross-strut 34 with the same rib 6.2) are delimited by the interruption points 31 of the line 10 as well as by the skew cuts 22; obviously, and as already stated, the skew cuts 21 and 22 allow said cross-struts 33 and 34 to be juxtaposed by overlapping one another.

The same cutting is strictly identical in the solid part of the sheet separating the ribs 6.2 and 6.3; it is therefore unnecessary to repeat the description, and it is sufficient simply to state that this cutting makes it possible to obtain sinuous cross-struts 35 and 36 which, as previously, are juxtaposed by overlapping one another.

The same type of expansion must be performed on the sheet to obtain the three-dimensional structure illustrated in FIG. 8. Obviously, the slope "a" of the oblique lines 23 to 25 is determined as already mentioned, and the joint nodes are therefore aligned in the course of the expansion at right angles to the ribs. On the other hand, in this case likewise, it is possible to align the nodes at right angles to the ribs on the unexpanded sheet of metal; this then has the result that the nodes become aligned askew during the expansion.

It appears unnecessary to describe in detail the three-dimensional structure such as is obtained by virtue of this second embodiment, since this is clear from FIG. 8; however, in order to facilitate understanding, it may be said that the cross-struts 7 of the first embodiment are multiplied by two to give rise in the second embodiment to the cross-struts 33 and 34, and that, in the same way, the cross-struts 8 of the first embodiment are multiplied by two to give rise in the second form of embodiment to the cross-struts 35 and 36.

The cutting principle expounded with reference to FIGS. 7 and 8 may obviously be generalised; indeed, the number of cross-struts taken from one and the same solid part separating two consecutive ribs may be further multiplied, simply by multiplying in the same proportion the number of mutually parallel skew cuts.

FIGS. 9 to 12 illustrate a third embodiment of the monolithic three-dimensional reinforcement 1.

It comprises mutually parallel and mutually spaced ribs; these ribs are designated by the general reference 6 and are distinguished by an index defining their rank; it is important to note immediately that the ribs of odd rank 6.1, 6.3, 6.5, 6.7, 6.9 . . . 6.2n+1 are intended to delimit one of the faces of the reinforcement, whereas the ribs of even rank 6.2, 6.4, 6.6, 6.8 . . . 6.2n are intended to delimit the opposite face of said reinforcement.

The ribs 6 are mutually separated by solid parts of the sheet 5 intended to form the cross-struts 57, 58, 67 and 68 terminating at the joint nodes 59, 69, 79 and 89 of the ribs 6.1, 6.5, . . . 6.4n+1; 6.3, 6.7, . . . 6.4n+3; 6.4, 6.8 . . . 6.4n; 6.2, 6.6 . . . 6.4n+2 respectively.

Considering the ribs of odd rank 6.2n+1 in FIG. 10, the cross-struts 57 extend above and to the right, whereas the cross-struts 58 extend below and to the left, a cross-strut 57 being conjugate with a cross-strut 58 to terminate at a node 59 of a rib of odd rank 6.4n+1, such as the rib 5.5; the cross-struts 67 extend above and to the left, whereas the cross-struts 68 extend below and to the right, a cross-strut 67 being conjugate with a cross-strut 68 to terminate at a node 69 of a rib of odd rank; 6.4n+3, such as the rib 6.3; the ribs of odd rank 6.2n+1 being alternately equipped with nodes 59 with cross-struts 57, 58, and nodes 69 with cross-struts 67, 68.

Now considering the ribs of even rank 6.2n in FIG. 2, they are alternately equipped:

with nodes 79 (ribs 6.4n such as the rib 6.4) upon which upper cross-struts 68 and lower cross-struts 67 converge from the left.

with nodes 89 (ribs 6.4n+2 such as the rib 6.2) upon which upper cross-struts 58 and lower cross-struts 67 converge from the right.

To obtain this particular arrangement of the ribs 6, of the cross-struts 57, 58, 67, 68 and of the nodes 59, 69, 79 and 89, each rib 6 is delimited by two interrupted cutting lines 50, 51, the interruptions of which permit solid parts to be left which specifically form the above-mentioned joint nodes. These lines 50, 51 separate the ribs from the cross-struts and are extended by skew cuts 52 to 55 which detach each cross-strut from that with which it is aligned before expansion and, at the same time, which delimit those parts of the nodes projecting laterally from the ribs.

Thus each node 59.4n+1 is delimited by the skew cuts 52 and 53, each node 69.4n+3 is delimited by the skew cuts 54 and 55, each node 79.4n is delimited by the skew cuts 52 and 55 common to the adjacent nodes 59 and 69, each node 89.4n+2 is delimited by the skew cuts 53 and 54 common to the adjacent nodes 59 and 69.

These skew cuts are oriented and distributed in a highly specific manner analysed below with reference to FIG. 12. The sheet of metal 5 is divided into narrow strips by the cutting lines 50 and 51, which are interrupted at points 50*a*, 50*b* and 51*a*, 51*b* respectively aligned on imaginary straight lines 61*a*, 61*b*, the latter being perpendicular to the cutting lines 50, 51 and spaced correspondingly to the size chosen for the nodes (left-hand half of FIG. 12). Four adjacent points 50*a*, 50*b*, 51*a* and 51*b* could be joined by imaginary diagonals 62 and 63.

As the right-hand half of FIG. 12 shows, the above-mentioned strips form successively the rib 6.1, the cross-struts 58, the rib 6.2, the cross-struts 67, the rib 6.3, the cross-struts 68, the rib 6.4, the cross-struts 57, the rib 6.5, the cross-struts 58, the rib 6.6 and so forth. Moreover, the skew cuts 52 and 53 are parallel to the diagonal 69, whereas the skew cuts 54 and 55 are parallel to the conjugate diagonal 63; these skew cuts are distributed so as to be successively mutually parallel by twos and mutually divergent by twos.

Thus, still with reference to the right-hand half of FIG. 12:

the node 89 is defined by two skew cuts 53 and 54 converging to the left on the rib 6.2 and diverging to the right on two cross-struts 58 and 67 framing this rib, which is separated from them by the cutting lines 50 and 51 as far as the points 50*b* and 51*b*, the node 69 is defined by two parallel skew cuts 54 and 55 inclined from top left to bottom right to join cross-struts 67 and 68 to the rib 6.3 beyond the interruption points 50*a* and 51*b* of the cutting lines 50 and 51 which separate this rib 6.3 from said cross-struts 67 and 68 running on either side in extension, the node 79 is defined by two skew cuts 55 and 52 converging to the right on the rib 6.4 and diverging to the left on two cross-struts 68 and 57 framing this rib, which is separated from them by the lines 50 and 51 as far as the points 50*a* and 51*a*, the node 59 is defined by two parallel skew cuts 52 and 53 inclined from bottom left to top right to join cross-struts 58 and 57 to the rib 6.5 beyond the interruption points 51*a* and 50*b* of the cutting lines 51 and 50 which separate this rib 6.5 from cross-struts 58 and 57 running on either side in extension.

In order to expand the sheet 5 precut in this manner, it is necessary, as is clear from FIG. 11:

to anchor longitudinally in a base plane the ribs of odd rank 6.1, 6.3, 6.5, 6.7, 6.9 . . . 6.2n+1, and to pull longitudinally upon the ribs of even rank 6.2n, removing them both transversely from the former and perpendicularly from their base plane, this traction being alternately to the right for the ribs 6.4, 6.8 . . . 6.4n and to the left for the ribs 6.2, 6.6 . . . 6.4n+2.

Of course, during this movement, the cross-struts are inclined symmetrically, the cross-struts 58 and 67 of the nodes 89 of even rank 4n+2 to bottom right, (FIG. 11) and the cross-struts 68 and 57 of the nodes 79 of even rank 4n to bottom left (FIG. 11). This inclination is accompanied by a bending of the cross-struts at the position of the joint nodes:

for the cross-struts 57, along the bending line 57*a* of the node of even rank 79.4n and along the bending line 57*b* of the node of odd rank 59.4n+1 (FIGS. 11 and 12), for the cross-struts 58, along the bending line 58*a* of the node of odd rank 59.4n+1 and along the bending line 58*b* of the node of even rank 89.4n+2 (FIGS. 11 and 12), for the cross-struts 67, along the bending line 67*a* of the node of odd rank 69.4n+3 and along the bending line 67*b* of the node of even rank 89.4n+2, for the cross-struts 68, along the bending line 68*a* of the node of even rank 79.4n and along the bending line 68*b* of the node of odd rank 69.4n+3, all these bending lines joining an interruption point 50*a* or 51*a*, 50*b* or 51*b* of the cutting lines 50, 51 of one rib, to the homologous interruption point located opposite 51*a* or 50*b*, 51*b* or 50*b* of the cutting lines of the adjacent rib.

With a reinforcement 1 made of expanded metal as indicated above with reference to FIGS. 1 to 6 for the first embodiment, 7 and 8 for the second, 9 to 12 for the third, it is very easy to produce a panel similar to that illustrated in FIG. 4. These panels have sufficient strength and rigidity for the constructions for which these panels are intended; FIG. 13 shows three panels 41.1 to 41.3 which are aligned end to end during assembly. Of course, the coverings 3 and 4 have not been applied and the stability of the reinforcements 1 is ensured solely by their self-rigidity and by the integrated layers 2.

To effect the joining of these panels to one another and to prevent cracks appearing subsequently, transverse bars 42 are laid at different regularly spaced heights. These bars have no special features, except that hooks 43 and 44 are formed by the ends of each bar. The shaping of the hooks is effected by force and has the object to join the extreme rib of one panel with the adjacent extreme rib of the contiguous panel; thus a true cross-bracing of the assembly of the panels is obtained, which at the same time ensures strong jointing of the extreme ribs which are in the proximity of the contact edges of said panels. When the wall or other element of the construction is erected as indicated above, the material constituting the coverings 3 and 4 is then applied continuously, and no solution of continuity then remains.

The invention is not limited to the embodiments illustrated and described in detail, since various modifications may be made thereto without departing from its scope.

I claim:

1. A three-dimensional monolithic structure of expanded metal formed from an expandable metal plane sheet usable in a building construction panel or the like, said structure exhibiting mutually parallel ribs at opposite first and second faces of the structure and inclined cross-struts formed by interrupted cutting lines in the sheet, the cross-struts inwardly joining the ribs at shaped joint nodes of shapes formed by the cutting lines, wherein each node of each rib of even rank which defines a first face of the structure is in the form of a triangle and connects the adjacent ends of two cross-struts extending respectively on the two sides of the associated rib and in the same direction, and the directions being reversed for the cross-struts of the two consecutive ribs of even rank, and each node of each rib of odd rank which defines the second face of the structure being in the form of a parallelogram and connects to the adjacent ends of two cross-struts extending respectively on the two sides of the associated rib and in opposite directions, and the directions being reversed for the homologous cross-struts of two consecutive ribs of odd rank.

2. Structure according to claim 1, wherein the joint nodes are arranged, on the plane unexpanded metal, along lines perpendicular to the ribs, and wherein, during the expansion, if the nodes in parallelogram form of the ribs of odd rank are anchored longitudinally, the nodes in triangle form of each rib of even rank are moved longitudinally, in one direction for a given rib of even rank, and in the opposite direction, for the two ribs of even rank consecutive thereto, so that the cross-struts are inclined in opposite directions for two consecutive ribs of even rank while the first face defined by said ribs of even rank moves away from the second face defined by the ribs of odd rank.

3. Structure according to claim 2, wherein, during the extension of the precut metallic sheet, the ribs are separated crosswise one from the other.

4. Structure according to claim 2, wherein each joint node in parallelogram form of a rib of odd rank consists of that part of the latter on which the two cross-struts of opposite directions which are connected to it terminate, and by the ends of these cross-struts which are separated from those of the cross-struts running in extension by two skew cuts which are parallel mutually and to the line joining two diagonally opposite points of this part, the skew cuts of a rib of odd rank being inclined symmetrically relative to those of the two consecutive ribs of odd rank.

5. Structure according to claim 2, wherein each joint node in triangle form of a rib of even rank consists of that part of the latter on which the two cross-struts of the same direction which are connected to it terminate, and by the ends of these cross-struts which are separated from those of the cross-struts running in extension by two skew cuts, which are respectively parallel to the two lines joining diagonally the four points of this part, the skew cuts of a rib of even rank converging oppositely to those of the consecutive ribs of even rank.

6. Building construction panel comprising a plurality of structures according to claim 1 coated by a material which is pourable, sprayable, foamable or the like, wherein at the time of placing the structures in mutual extension and in contact by their extreme edges defined by the even terminal ribs of the first face and odd terminal ribs of the second face, the ribs of each structure are formed with regularly spaced transverse bars, the ends of which are fixed by forced hooking to the ribs of two contiguous structures.

* * * * *